US007933426B2

(12) United States Patent
Vinson et al.

(10) Patent No.: US 7,933,426 B2
(45) Date of Patent: Apr. 26, 2011

(54) REMOVABLE SPEAKER ARRANGEMENT

(75) Inventors: David C. Vinson, San Jose, CA (US); Dean Depay, San Jose, CA (US); Raphael Gemez, Los Altos, CA (US); Alexander Thatcher, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1687 days.

(21) Appl. No.: 11/180,999

(22) Filed: Jul. 12, 2005

(65) Prior Publication Data

US 2007/0012166 A1 Jan. 18, 2007

(51) Int. Cl.
*H04R 1/02* (2006.01)
*H04R 9/06* (2006.01)
*H04R 5/02* (2006.01)

(52) U.S. Cl. ..... 381/333; 381/306; 381/335; 381/386; 381/388

(58) Field of Classification Search ..... 381/77, 381/332, 333, 335, 306, 366, 388, 394, 393, 381/379, 386, 387, 361, 334
See application file for complete search history.

(56) References Cited

U.S. PATENT DOCUMENTS

| | | | | |
|---|---|---|---|---|
| 5,675,426 | A * | 10/1997 | Meisner et al. | 348/838 |
| 5,732,331 | A * | 3/1998 | Harms | 455/575.3 |
| 6,151,401 | A * | 11/2000 | Annaratone | 381/388 |
| 2002/0110249 | A1 * | 8/2002 | Jeon et al. | 381/74 |
| 2002/0141164 | A1 * | 10/2002 | Watanabe et al. | 361/749 |

* cited by examiner

*Primary Examiner* — Vivian Chin
*Assistant Examiner* — Douglas J Suthers

(57) ABSTRACT

An exemplary embodiment of the invention includes removable speaker arrangements. A speaker structure is pivotally mounted with a first base such that the speaker structure pivots around an axis of rotation, and the first base configured to slidingly receive the speaker structure. A first plurality of electronic contacts are in electronic communication with the first base. A second plurality of electronic contacts are in electronic communication with the speaker structure and are configured to maintain electronic communication with the first plurality of electronic connectors throughout the axis of rotation. In some embodiments, the first base further includes a wireless transmitter. In some embodiments, speaker arrangements further includes a second base configured to slidingly receive the speaker structure. In some embodiments, the second base includes a power supply and a wireless receiver for maintaining electronic communication with the first base.

22 Claims, 4 Drawing Sheets

REMOVABLE SPEAKER ARRANGEMENT

BACKGROUND

Audio/Video (A/V) media devices and related accessories proliferate in modern consumer markets. Indeed, A/V delivery demands have continued to fuel innovation in display and audio technologies resulting in a plethora of configurations to meet consumer tastes and preferences. The last decade has introduced flat screen and plasma displays which promise high definition video in a low profile configuration. Audio technology continues to evolve as well with audiophile sound reproduction and surround sound services enabled on even modestly priced configurations.

As advanced as some of these technologies have become, some design areas continue to resist innovation. For example, stereophonic speakers are typically connected with their associated audio components via a length of cable. In the past, attempts to reduce cable clutter include using: cut-to-length cables; tangs to wrap cable; or built-in cable stowage. But even these attempts only reduce cable length without reducing cables altogether. This problem is especially pronounced because users may wish to locate their speakers away from a display or audio device to improve stereo or surround sound field effects. Thus, cables must be provided to carry audio signal to remotely placed speakers. In those examples, elimination of cabling may not be possible in conventional applications.

In addition, with flat screen display technologies continuing to evolve lower pricing structures due to mass appeal coupled with production efficiencies, flat screen televisions and plasma displays are entering home markets more aggressively. These applications require flexible configurations in order to broadly appeal to home users. Removable speakers, in conventional applications, may require unsightly cabling since flat screen displays may be mounted on a living room wall instead of in an entertainment center. Thus, in these highly visible applications, elimination of cabling may be desirable.

Therefore, removable speaker arrangements lacking external cabling are presented herein.

SUMMARY

An exemplary embodiment of the invention includes removable speaker arrangements. A speaker structure is pivotally mounted with a first base such that the speaker structure pivots around an axis of rotation, and the first base configured to slidingly receive the speaker structure. A first plurality of electronic contacts are in electronic communication with the first base. A second plurality of electronic contacts are in electronic communication with the speaker structure and are configured to maintain electronic communication with the first plurality of electronic connectors throughout the axis of rotation. In some embodiments, the first base further includes a wireless transmitter. In some embodiments, speaker arrangements further includes a second base configured to slidingly receive the speaker structure. In some embodiments, the second base includes a power supply and a wireless receiver for maintaining electronic communication with the first base. In some embodiments, the power supply includes a charging component and a power storage component.

Advantages of the invention include flexible configuration of speaker arrangements that eliminate unsightly electronic connections. The invention further includes hidden wired and wireless communication between a base and speakers.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF EMBODIMENTS

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1A:
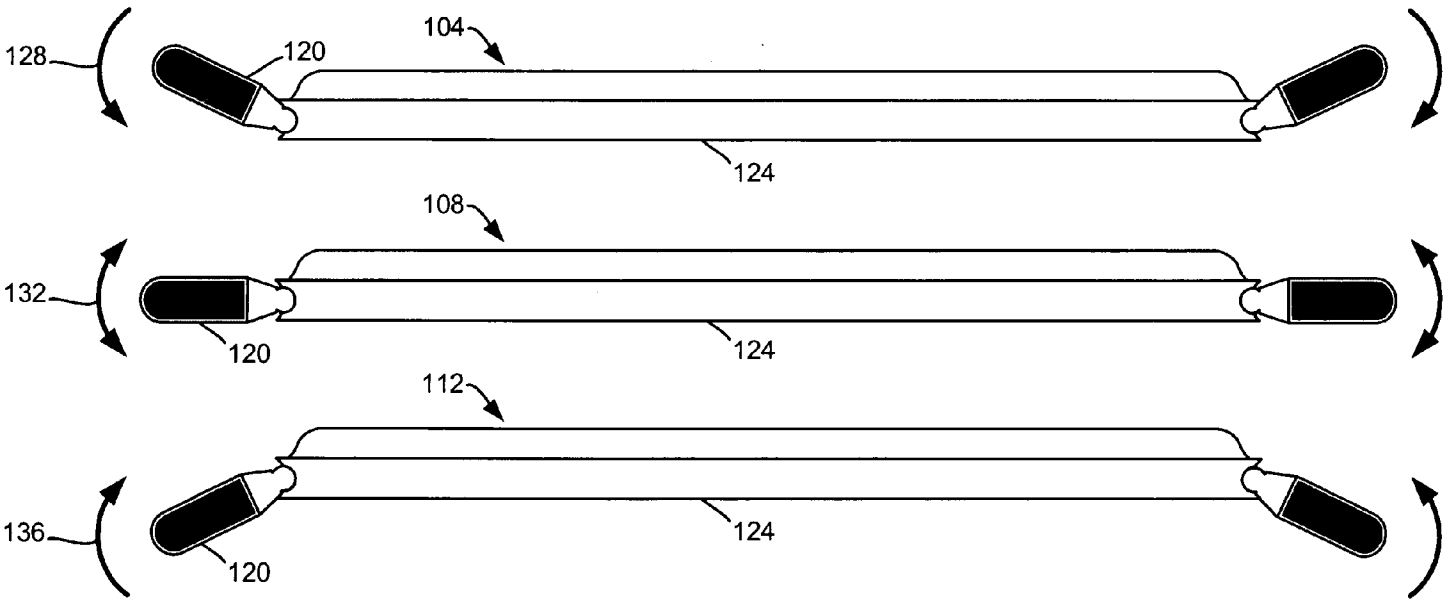
FIGS. 1A-B are illustrative representations of a top view of embodiments of the present invention.
Figure 1B:
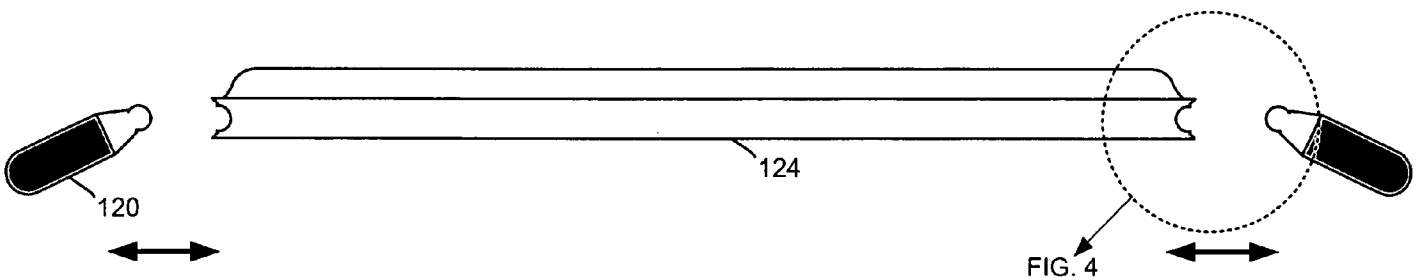

Various embodiments are described herein below, including methods and techniques. FIGS. 1A-B are illustrative representations of a top view of embodiments of the present invention. In the example illustrated, speaker 120 may be pivotally mounted with display 124. As illustrated in FIG. 1A, display 124 is a thin panel display which may be configured as an LCD display or a plasma display. In some embodiments, display may be a CRT. In other embodiments, speaker 120 may be mounted with an audio only component such as a radio, for example. As can be seen, speaker 120 may pivotally move (128-136) around an axis of rotation. At least three configuration positions (104-112) are illustrated. As can be appreciated, placement of speakers relative to a listener may be critical to achieving a proper stereophonic effect for a listener. Thus, pivoting speakers may serve to optimally project sound toward a viewer or set of viewers. Various positions may be maintained by indents (not shown) or by a friction element (not shown) applied to sliding surfaces as can be appreciated by one skilled in the art.

FIG. 1B illustrates speakers 120 removed from display 124. As can be seen, no external cabling is required in any of the illustrated embodiments. Detail for electronic communication components is described in exploded view FIG. 4 below. As illustrated, now unmounted speaker 120 may be readily moved in accordance with user preferences to obtain acoustically pleasing effects without cable clutter.

Figure 2A:
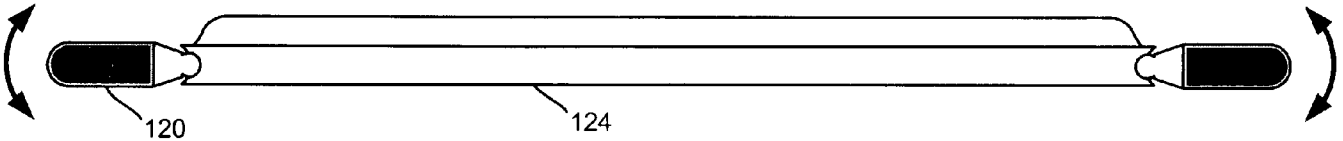
FIGS. 2A-C are illustrative representations of a top view of embodiments of the present invention.
Figure 2B:
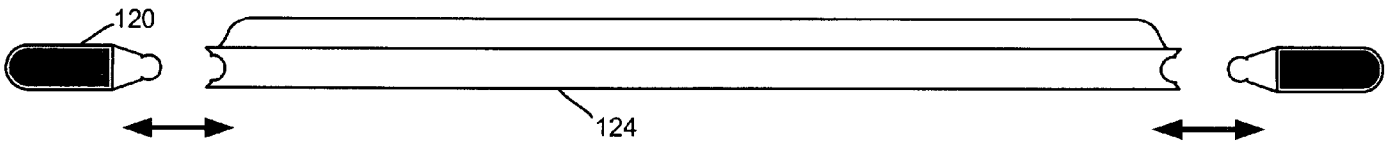
Figure 2C:
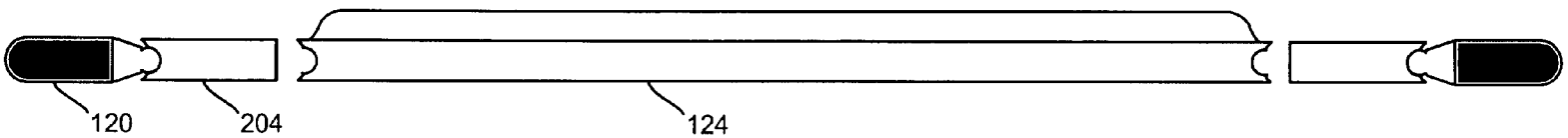

FIGS. 2A-C are illustrative representations of a top view of embodiments of the present invention. FIG. 2A illustrates a top view of speaker 120 pivotally mounted with display 124 in an embodiment of the present invention. FIG. 2B illustrates now unmounted speaker 120 as in FIG. 1B. FIG. 2C illustrates speaker 120 coupled with a remote base 204. As can be appreciated, because no external cabling is required in embodiments of the present invention, speaker 120 must be configured to remain in electronic communication with display 124. As such, a remote base 204 may be configured to maintain electronic communication with display. In some embodiments of the present invention, remote base 204 may be configured to receive wireless communication from display 124 further eliminating cable-clutter. As can be appreciated, any number of wireless formats may be utilized without departing from the present invention including, for example, FM, AM, UHF, VHF, 802.11b, 802.16b, infrared, HomeRF, and Bluetooth. In still other embodiments, remote base 204 may be configured with a charging component and a power storage component further eliminating cable-clutter when remotely placing speakers.

Figure 3:
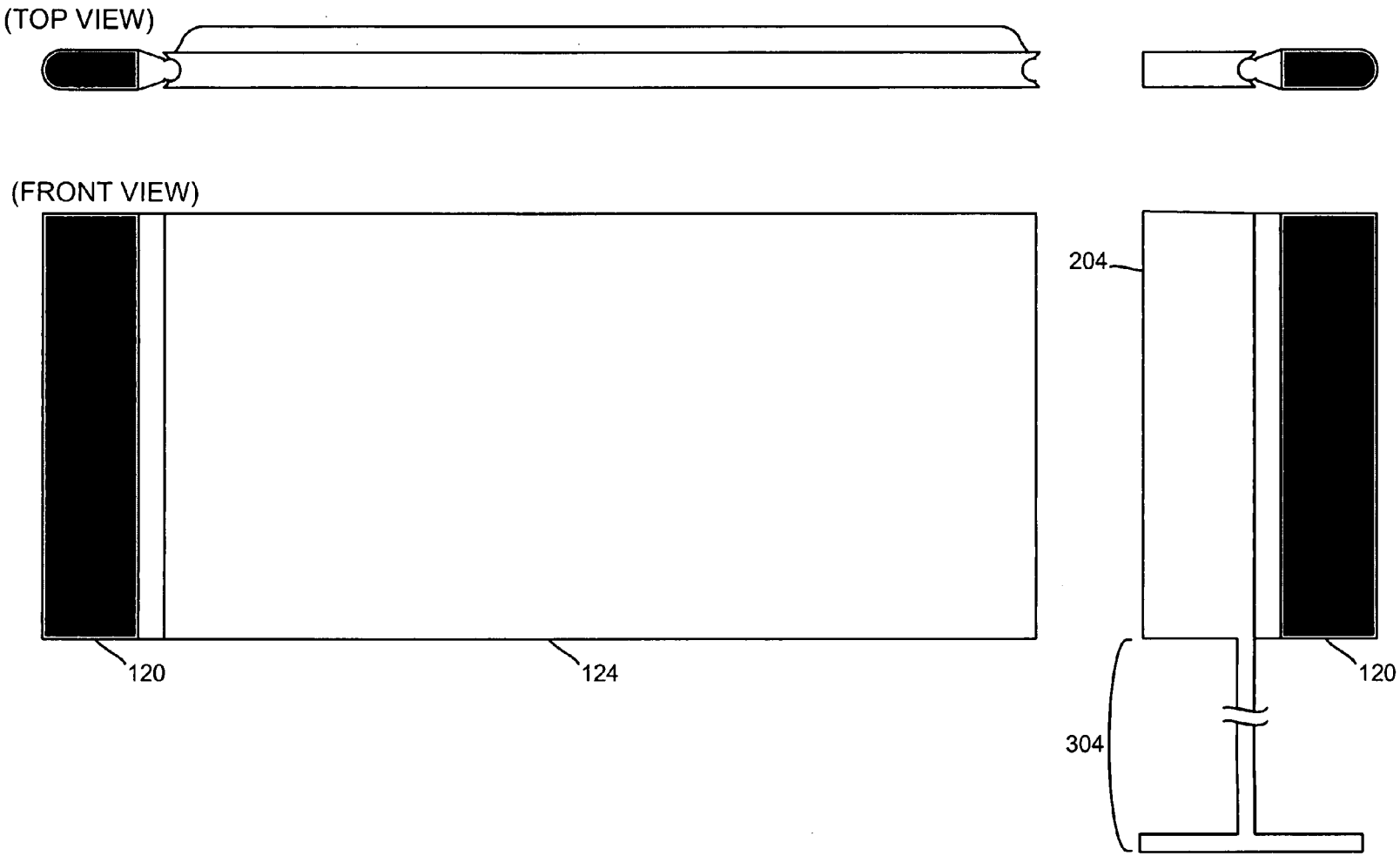
FIG. 3 is an illustrative representation of a top view and front view of an embodiment of the present invention.

FIG. 3 is an illustrative representation of a top view and a front view of an embodiment of the present invention. As illustrated display 124 may be configured such that speaker 120 is remotely mounted with remote base 204. In the example illustrated, remote base 204 includes a stand portion 304. Stand portion 304 may be utilized to elevate remote base 204 above a horizontal surface. Stand portion 304 may elevate remote base 204 to any distance in accordance with user preferences. In some embodiments, stand portion 304 may be free standing. In other embodiments, stand portion 304 may be configured to mate with an integrated system. As noted above, display 124 as shown is for illustrative purposes only and should not be construed as limiting. Thus, for example, any video source as well as any audio source may serve as a base for speaker arrangement 120.

Figure 4:
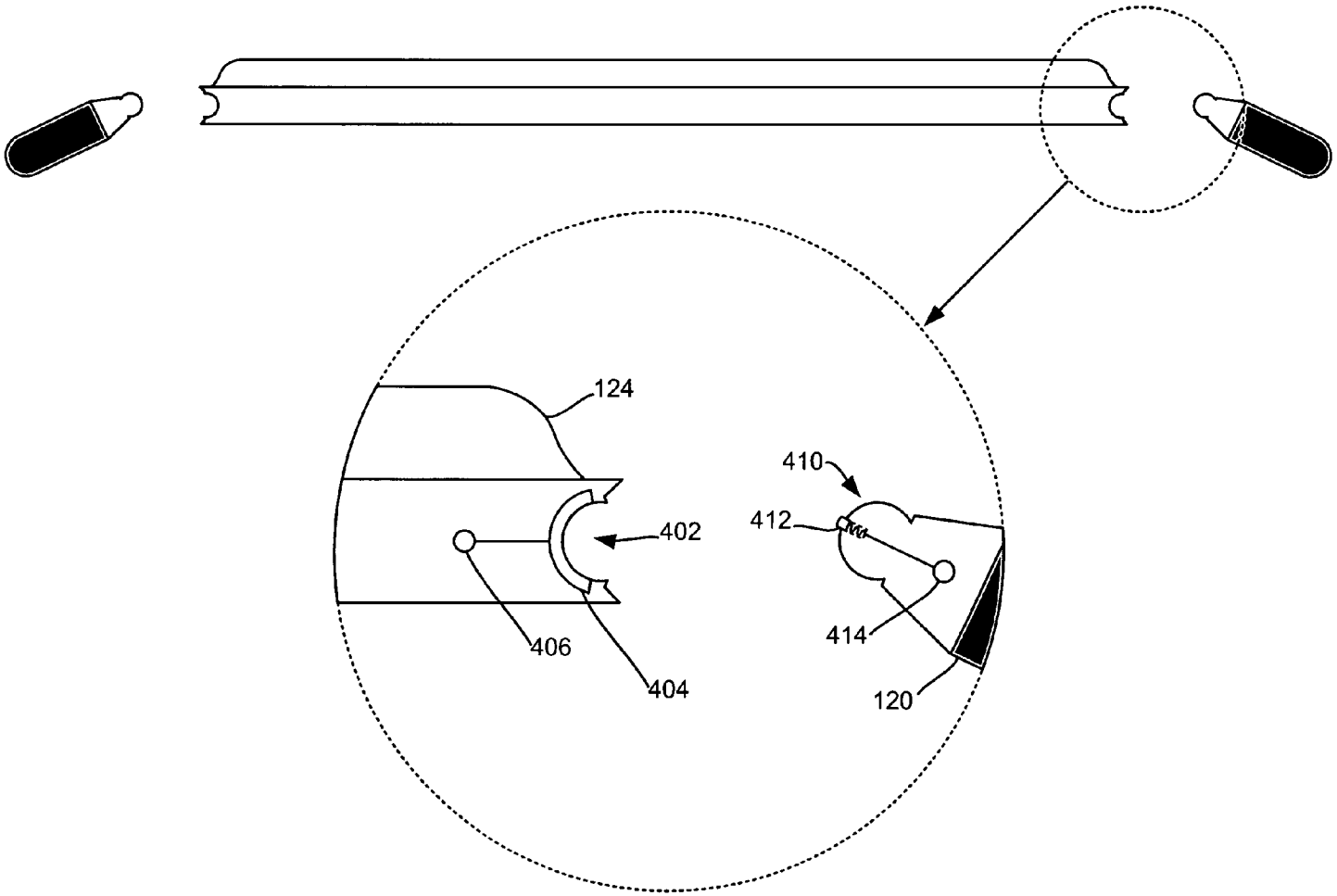
FIG. 4 is an illustrative representation of an exploded top view of an embodiment of the present invention.

FIG. 4 is an illustrative representation of an exploded top view of an embodiment of the present invention. In particular a portion of display 124 and speaker 120 is shown in exploded view. Pivotal movement of speaker 120 is accomplished using a groove portion 402 of display 124 in cooperative movement with tongue portion 410 of speaker 120. Groove portion 402 allows tongue portion 410 to pivot around an axis of rotation as illustrated in FIGS. 1A-C. Display 124 may be configured with an electronic contact 404. Electronic contact 404 provides electronic communication with display 124 via internal connection 406. As can be appreciated, electronic contact 404 is configured to match the contour of groove 402 such that tongue 410 may pivot smoothly. Further, because at least two electronic contacts are required to transmit audio information (more contacts may be necessary for additional audio encoded information), the electronic contacts must remain electrically isolated from each other. Electrical isolation is well known in the art and may be accomplished using any number of suitable materials.

Speaker 120 may be configured with an electrical contact 412. Electronic contact 412 provides electronic communication with speaker 120 via internal connection 414. Electronic contact 412 is configured to maintain electrical communication with electrical contact 404. As such, audio signals may continue uninterrupted through out speaker 120 range of motion. As illustrated, electronic contact 412 may be configured with a tensioning device such as a spring to promote effective electrical contact as well as to provide resistance against groove 402 so that speaker position may be maintained. As can be appreciated, surface areas of electronic contacts may be configured without limitation in accordance with designer preferences with respect to desired audio characteristics. In some embodiments, it is believed that higher contact surface area corresponds to reduced impedance resulting in higher audio signal quality. In other embodiments, a contact lubricant may be utilized to improve electronic contact efficiency.

While the invention has been described in terms of several embodiments and the best mode, there are alterations, permutations, and equivalents, which fall within the scope of this invention. It should also be noted that there are many alternative ways of implementing the methods and apparatuses of the present invention. For example, although display 124 is configured with a groove 402 and speaker 120 is configured with a tongue 410, it can be appreciated that the arrangement of groove and tongue may be reversed such that display 124 is configured with a tongue and speaker 120 is configured with a groove. Furthermore, although embodiments shown include a remote base having a power source; it can be appreciated that a speaker may be configured to include a power source thus eliminating the need for a remote base. It is therefore intended that the following appended claims be interpreted as including all such alterations, permutations, and equivalents as fall within the true spirit and scope of the present invention.

What is claimed is:

1. A removable speaker arrangement comprising:

a speaker structure pivotally mounted with a first base such that the speaker structure pivots around an axis of rotation, a groove portion of the first base configured to pivotally receive a tongue portion of the speaker structure;

a first plurality of electronic contacts disposed within the groove portion and in electronic communication with the first base;

a second plurality of electronic contacts disposed on the tongue portion and in electronic communication with the speaker structure; the second plurality of electronic contacts configured to maintain electronic communication with the first plurality of electronic contacts throughout the pivoting around the axis of rotation; and a second base configured to receive the speaker structure, the second base comprising a power supply and a wireless receiver for maintaining electronic communication with the first base.

2. The speaker arrangement of claim 1 wherein the first base further comprises a wireless transmitter.

3. The speaker arrangement of claim 1 further comprising a tensioning element for maintaining the speaker structure in a desired position.

4. The speaker arrangement of claim 1 wherein the second base further comprises:

a stand component for raising the second base above a horizontal surface.

5. The speaker arrangement of claim 2 wherein the wireless transmitter is configured to send transmissions selected from the group consisting of FM, AM, UHF, VHF, 802.11b, 802.16b, infrared, HomeRF, and Bluetooth.

6. The speaker arrangement of claim 1 wherein the wireless receiver is configured to receive transmissions selected from the group consisting of FM, AM, UHF, VHF, 802.11b, 802.16b, infrared, HomeRF, and Bluetooth.

7. The speaker arrangement of claim 1 wherein the power supply comprises:

a charging component; and a power storage component.

8. The speaker arrangement of claim 1 wherein the arrangement is configured to process three dimensional sound signals.

9. A video display with removable speaker arrangement comprising:

a speaker structure pivotally mounted with the video display such that the speaker structure pivots around an axis of rotation, a groove portion of the video display configured to pivotally receive a tongue portion of the speaker structure;

a first plurality of electronic contacts disposed within the groove portion in electronic communication with the video display;

a second plurality of electronic contacts disposed on the tongue portion in electronic communication with the speaker structure; the second plurality of electronic contacts configured to maintain electronic communication with the first plurality of electronic contacts throughout the pivoting around the axis of rotation; and a second base remote from the video display and configured to receive the speaker structure, the second base comprising a power supply and a wireless receiver for maintaining electronic communication with the first base.

10. The video display with removable speaker arrangement of claim 9 wherein the video display is selected from the group consisting of a television display, a computer display, a plasma monitor, an LCD monitor, and a CRT monitor.

11. The video display with removable speaker arrangement of claim 9 wherein the video display further comprises a wireless transmitter.

12. The video display with removable speaker arrangement of claim 9 further comprising a tensioning element for maintaining the speaker structure in a desired position.

13. The video display with removable speaker arrangement of claim 9 wherein the second base further comprises:

a stand component for raising the second base above a horizontal surface.

14. The video display with removable speaker arrangement of claim 11 wherein the wireless transmitter is configured to send transmissions selected from the group consisting of FM, AM, UHF, VHF, 802.11b, 802.16b, infrared, HomeRF, and Bluetooth.

15. The video display with removable speaker arrangement of claim 9 wherein the wireless receiver is configured to receive transmissions selected from the group consisting of FM, AM, UHF, VHF, 802.11b, 802.16b, infrared, HomeRF, and Bluetooth.

16. The video display with removable speaker arrangement of claim 9 wherein the power supply comprises:

a charging component; and a power storage component.

17. The video display with removable speaker arrangement of claim 9 wherein the arrangement is configured to process three dimensional sound signals.

18. A removable speaker arrangement comprising:

a speaker structure pivotally mounted with a first base such that the speaker structure pivots around an axis of rotation, a groove portion of the first base configured to pivotally receive a tongue portion of the speaker structure;

a first electronic contact means disposed within the groove portion for establishing an electronic connection with the first base;

a second electronic contact means disposed on the tongue portion for establishing an electronic connection with the speaker structure; the second electronic contact means configured to maintain electronic communication with the first electronic contact means throughout the pivoting around the axis of rotation; and a second base configured to receive the speaker structure, the second base comprising a power supply and a wireless receiver for maintaining electronic communication with the first base.

19. The removable speaker arrangement of claim 18 wherein the first base further comprises means for wireless transmission.

20. The removable speaker arrangement of claim 1, wherein the second base comprises:

a second groove portion configured to pivotally receive the tongue portion of the speaker structure; and a third plurality of electronic contacts disposed within the second groove portion and in electronic communication with the second base and configured to provide electronic communication with the second plurality of electronic contacts on the tongue portion of the speaker structure.

21. The video display with removable speaker arrangement of claim 9, wherein the second base comprises:

a second groove portion configured to pivotally receive the tongue portion of the speaker structure; and a third plurality of electronic contacts disposed within the second groove portion and in electronic communication with the second base and configured to provide electronic communication with the second plurality of electronic contacts on the tongue portion of the speaker structure.

22. The removable speaker arrangement of claim 18, wherein the second base comprises:

a second groove portion configured to pivotally receive the tongue portion of the speaker structure; and a third electronic contact means disposed within the second groove portion and in electronic communication with the second base and configured to provide electronic communication with the second electronic contact means on the tongue portion of the speaker structure.

* * * * *